US008101326B2

(12) United States Patent
Morgan et al.

(10) Patent No.: US 8,101,326 B2
(45) Date of Patent: Jan. 24, 2012

(54) SECURE DOCUMENT PRINTING METHOD AND SYSTEM

(75) Inventors: Jason Morgan, Fairport, NY (US); John F. Crichton, Honeoye Falls, NY (US); Raymond Rossborough, Geneseo, NY (US); Timothy G. Armstrong, Rochester, NY (US); Matthias H. Regelsberger, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 1577 days.

(21) Appl. No.: 11/437,796

(22) Filed: May 19, 2006

(65) Prior Publication Data

US 2007/0268341 A1 Nov. 22, 2007

(51) Int. Cl.
*G03G 13/01* (2006.01)

(52) U.S. Cl. ..... 430/45.51; 347/74; 347/115; 347/117; 399/184; 399/223; 399/231; 430/45.53; 430/46.1; 430/106.1; 430/106.2; 430/106.3

(58) Field of Classification Search ..... 347/74, 347/115, 117; 399/184, 223, 231; 430/42.1, 430/45.51, 45.53, 46.1, 106.1, 106.2, 106.3
See application file for complete search history.

(56) References Cited

U.S. PATENT DOCUMENTS 4,546,060 A 10/1985 Miskinis et al.
4,901,114 A * 2/1990 Parker et al. ..... 399/232
4,925,215 A * 5/1990 Klaiber ..... 283/82
4,980,719 A * 12/1990 Allen et al. ..... 399/3
5,009,973 A * 4/1991 Yoshida et al. ..... 430/119.84
5,021,838 A 6/1991 Parker et al.
5,083,157 A * 1/1992 Smith et al. ..... 399/335
5,126,221 A * 6/1992 Chiba et al. ..... 430/45.51
5,200,285 A * 4/1993 Carrish ..... 430/45.1
5,254,196 A * 10/1993 Abowitz et al. ..... 156/235
5,285,246 A * 2/1994 Danzuka et al. ..... 430/45.1
5,291,243 A * 3/1994 Heckman et al. ..... 399/3
5,347,302 A * 9/1994 Simonoff ..... 347/139
5,368,334 A * 11/1994 Christy et al. ..... 283/67
5,514,467 A * 5/1996 Berkes et al. ..... 428/840
5,714,291 A * 2/1998 Marinello et al. ..... 430/108.1
5,783,346 A 7/1998 Jadwin et al.
5,828,385 A * 10/1998 Smith et al. ..... 346/74.2
5,840,457 A * 11/1998 Urawa et al. ..... 430/45.51
5,917,996 A * 6/1999 Thorpe ..... 358/1.14
5,972,553 A * 10/1999 Katada et al. ..... 430/108.23
6,025,862 A 2/2000 Thompson
6,086,708 A 7/2000 Colgate, Jr.
6,167,224 A * 12/2000 Dalal ..... 399/222
6,383,701 B1 * 5/2002 Tohata ..... 430/106.1
6,610,451 B2 8/2003 Jadwin et al.
6,764,015 B1 * 7/2004 Pearson ..... 235/487
6,766,136 B2 7/2004 Jadwin et al.
6,909,856 B2 6/2005 Crichton
7,066,668 B2 * 6/2006 Sandison et al. ..... 400/578
7,430,389 B2 * 9/2008 Noguchi et al. ..... 399/223

(Continued)

*Primary Examiner* — David Gray
*Assistant Examiner* — Geoffrey Evans
(74) *Attorney, Agent, or Firm* — Donna P. Suchy

(57) ABSTRACT

A method and system for printing documents with one or more embedded security features is provided. Security features are embedded in the document by co-printing magnetic and non-magnetic toner on a receiver before fixation by a fixing station. The combination of magnetic and non-magnetic toners in the image results in image elements that easily show alteration or are undetectable by visual means.

8 Claims, 10 Drawing Sheets
(1 of 10 Drawing Sheet(s) Filed in Color)

U.S. PATENT DOCUMENTS

| | | | | |
|---|---|---|---|---|
| 7,522,869 | B2 * | 4/2009 | Anderson et al. | 399/297 |
| 7,542,707 | B2 * | 6/2009 | Omata | 399/302 |
| 7,734,199 | B2 * | 6/2010 | Mastie et al. | 399/15 |
| 7,954,714 | B2 * | 6/2011 | Anderson et al. | 235/449 |
| 7,965,961 | B2 * | 6/2011 | Priebe et al. | 399/231 |
| 7,970,328 | B2 * | 6/2011 | Halfyard et al. | 399/325 |
| 2002/0115006 | A1 | 8/2002 | Jadwin et al. | |
| 2003/0190541 | A1 | 10/2003 | Jadwin et al. | |
| 2004/0001973 | A1 * | 1/2004 | Gao et al. | 428/693 |
| 2004/0115542 | A1 * | 6/2004 | Nonaka et al. | 430/45 |
| 2004/0219447 | A1 | 11/2004 | Jadwin et al. | |
| 2004/0253530 | A1 * | 12/2004 | Serizawa et al. | 430/124 |
| 2005/0142468 | A1 | 6/2005 | Blood et al. | |
| 2005/0142469 | A1 | 6/2005 | Blood et al. | |
| 2005/0207635 | A1 | 9/2005 | Lazar et al. | |
| 2005/0219583 | A1 | 10/2005 | Foster et al. | |
| 2005/0220518 | A1 * | 10/2005 | Priebe | 399/390 |
| 2005/0281434 | A1 * | 12/2005 | Handley et al. | 382/100 |
| 2005/0282077 | A1 | 12/2005 | Riley et al. | |
| 2006/0230273 | A1 * | 10/2006 | Crichton | 713/176 |
| 2007/0268511 | A1 * | 11/2007 | Crichton et al. | 358/1.14 |
| 2011/0111337 | A1 * | 5/2011 | Horie et al. | 430/106.2 |

* cited by examiner

SECURE DOCUMENT PRINTING METHOD AND SYSTEM

FIELD OF THE INVENTION

The present invention relates generally to printing documents with magnetic and non-magnetic image elements and, more particularly, to a method and apparatus for aligning and printing image elements within a document to create a secure document method and system.

BACKGROUND OF THE INVENTION

Billions of personal checks, business checks, tickets, pay stubs, vouchers, and other commercial documents are processed each year. The volume of documents being processed continues to increase despite the availability of paperless methods of making payments and/or transferring money.

The susceptibility of printed documents to fraudulent alteration costs the industry billions of dollars each year. Alteration takes the form of printing non-standard documents (forgery) and/or removal, addition or alteration of image elements on original documents. The industry is in need of methods to quickly and accurately assess the authenticity of a document and make document alteration more difficult.

Many schemes exist for printing secure documents. These generally fall into two categories, those that involve substrate manipulation and those that involve addition of image content. Examples of substrate manipulation include US20030211299 A1 which describes a coating for a retroreflective document which renders the surface of the document receptive to toners and inks printed thereon while not substantially interfering with the retroreflective properties of the underlying substrate. Methods for fabricating the document are also provided.

U.S. Pat. No. 5,888,622A provides a coated cellulosic web product and coating composition which provides enhanced toner adhesion for documents printed using noncontact printing devices such as ion deposition printers. The toner adhesion enhanced coating cellulosic product and composition comprises a cellulosic web having first and second major surfaces with at least one of the major surfaces having coated thereon a layer of a polymeric toner receptor.

U.S. Pat. No. 6,086,708A details a method of making a document, such as a check or stock certificate, having enhanced security against counterfeiting. The document includes a strip of foil having a three dimensional light diffracting image thereon affixed to the document. The strip of foil may be affixed to the document before or after the background printing or face printing of the document is completed. In this manner, the light diffracting strip may be printing on by the background and face printing of the document as desired.

Examples of methods that involve manipulation of image content or imaging materials include US20050282077A1 which describes a toner for printing documents that are difficult to chemically or physically forge and that are readily easy to visually verify and methods of using and forming the toner are disclosed. The toner includes a colorant for printing an image on a surface of a document and a dye for forming a latent version of the image underneath a surface of a substrate. An image formed using the toner of the invention is readily verified by comparing the colorant-formed image and the dye-formed image. In addition, if a solvent is used in an attempt to alter the printed image on the substrate, the dye migrates or diffuses to indicate tampering with the document.

US20050142468A1 describes a method of printing documents, for example bank checks, with a pantograph. Documents printed as described may include a digitally variable pantograph and other enhancements. The invention is particularly useful for enhanced security documents and the production thereof. US20050142469A1 describes a printing system, process and product with microprinting. Documents printed as described may include digitally variable microprint and other enhancements. The invention is particularly useful for enhanced security documents and the production thereof.

Despite these methods of security enhancement, document forgery and manipulation is still a problem.

SUMMARY OF THE INVENTION

The present invention provides an electrophotographic printing method and system, which generates documents with magnetic toner image elements with greatly improved resistance to tampering or fraudulent alteration. Document security features are realized by printing one or more non-magnetic toners on a receiver in addition to a magnetic toner where the combination of magnetic and non-magnetic toners is co-printed on the receiver before fixation. Using this method and system a variety of security features can be realized.

BRIEF DESCRIPTION OF THE DRAWINGS

The file of this patent contains at least one drawing executed in color. Copies of this patent with color drawing(s) will be provided by the Patent and Trademark Office upon request and payment of the necessary fee.

DETAILED DESCRIPTION OF THE INVENTION

The preferred embodiment of this invention will be described in connection with an electrographic printer, by way of example, because this invention is contemplated to be particularly beneficial in such an application. It will be appreciated by those skilled in the art having reference to this specification that this invention can also be used in any type of electrographic system, of any size or capacity. As such, this description is provided by way of example only, and is not intended or contemplated to limit the true scope of the invention as claimed.

Figure 1:
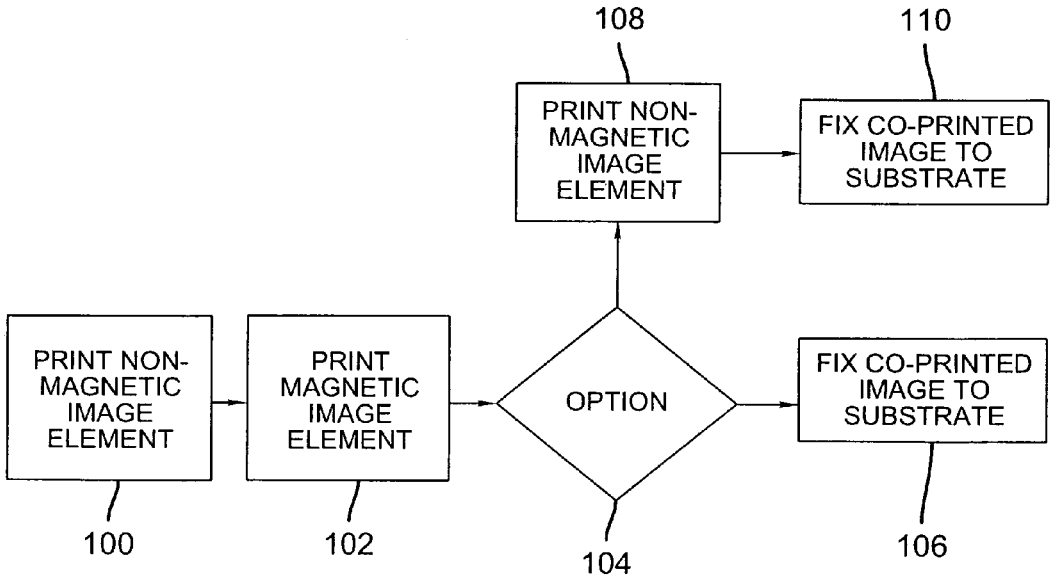
FIG. 1 presents a flow chart of the inventive printing process and system.

Referring now to FIG. 1, a flow chart of one exemplary method and related system for printing secure documents is illustrated in a general schematic sense, to provide a general context for the preferred embodiments of the invention; it is contemplated that this invention will be applicable to a wide range of printing machines. The method according to a preferred embodiment of the invention includes first printing a non-magnetic toner image element on a receiver, represented by step 100, printing a magnetic toner image element onto or next to the non-magnetic toner image elements, represented by step 102, then optionally fixing the image with heat and pressure, UV, IR, solvent, or any other fixing method known in the art, represented by step 104. Alternatively, the non-magnetic toner can be replaced by a combination of non-magnetic toner and magnetic toner that can be printed onto or next to the non-magnetic toner or even overprinted or under printed by non-magnetic toner as in 108. Finally the printed combination image, created by the image element(s), is fixed. This is sometimes referred to as fusing and can include fixing by heat and/or pressure as well as UV radiation, IR radiation, solvent or any other fixing methods, as represented by step 110. Details further describing printing and fixing the secure document using this method and system are given below.

Figure 2:
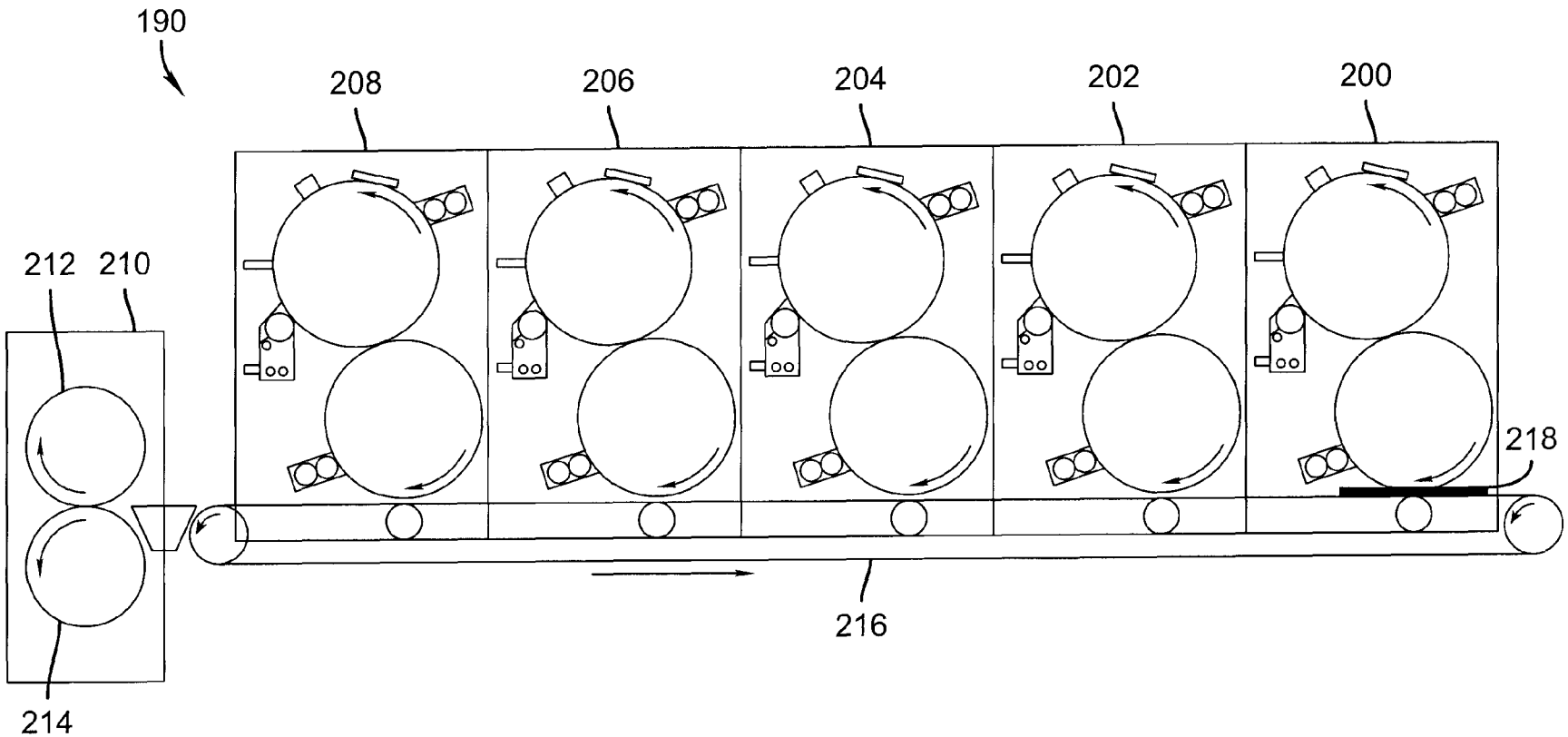
FIG. 2 presents a schematic diagram of an electrographic marking or reproduction system in accordance with the present invention.

FIG. 2 shows a schematic of a device 190, also referred to as a printing device, used for printing magnetic and non-magnetic image elements. The device 190 includes a plurality of development stations 200, 202, 204, 206, and 208. Each of these development stations may apply magnetic or non-magnetic toner image elements on the receiver 218. An example of the device 190 shown in FIG. 2 would be the NexPress 2100 digital printer sold by NexPress Solutions, Inc. In a preferred embodiment, non-magnetic toner image elements are first applied to the receiver by development stations 200, 202, 204, and 206. Also shown in FIG. 2 are fixing members 212 and 214 and belt 216, that carries receiver 218, that will be discussed in more detail below.

In a preferred implementation, the non-magnetic toner will have a viscosity of between 1 and 40,000 cpoise (40 kP) and an elasticity (tan delta) of between 1 and 20 where elasticity is defined as the ratio of the elastic modulus to the storage modulus of the toner as measured at 120 C on a parallel plate rheometer. In a preferred embodiment, the non-magnetic toner will have a viscosity between 10,000 and 15,000 cpoise (cp) and a tan delta between 2 and 4.5. In a more preferred embodiment, the non-magnetic toner will have a viscosity between 10,000 cp and 12,000 cp and a tan delta between 2 and 2.5. The non-magnetic toner may contain optical, UV, or IR sensitive pigments. The non-magnetic toner image elements will preferably be applied to the receiver at an optical transmission density of 0.01 to 5.00. One preferred non-magnetic toner is a NexPress DryInk sold by NexPress Solutions, Inc.

Figure 3:
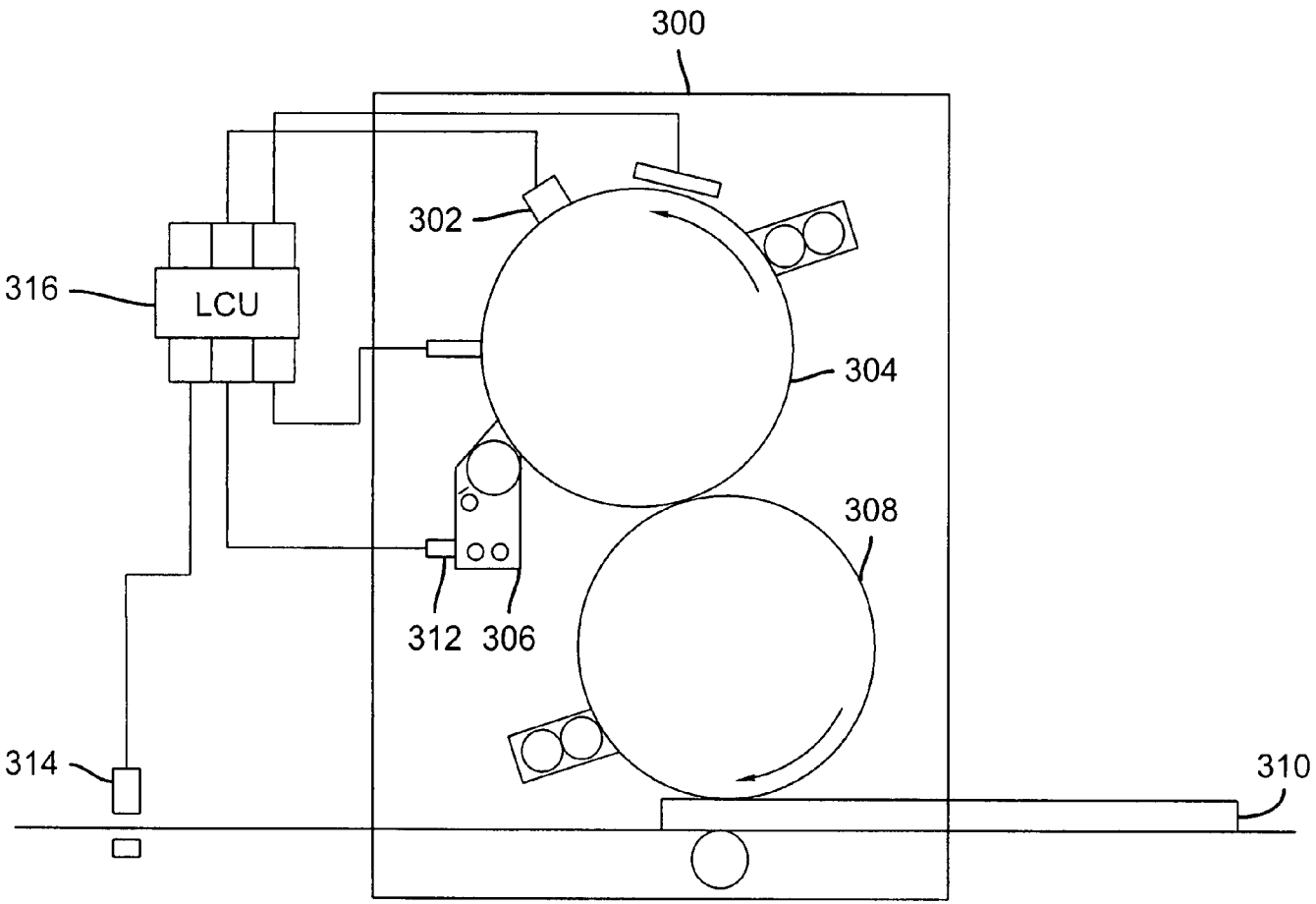
FIG. 3 presents a schematic diagram of an imaging unit in an electrographic marking or reproduction system in accordance with the present invention.

A detailed schematic of one exemplary imaging unit, such as imaging unit 200 shown in FIG. 2 is shown in FIG. 3. The imaging unit 300 is used to print magnetic and non-magnetic toners on receiver 218 and includes an optical writer 302, a charging element 310, an image forming member 304, a development station 306, a transfer member 308, a toner concentration sensor 312, an image density sensor 314, and a logic control unit 316. A uniform charge is applied to the imaging forming member 304 by the charging element 310. The image elements are written in the charge layer by discharging the charged layer with focused light from the optical writer 302. Examples of this image forming process are discussed in U.S. Pat. No. 6,909,856.

The image elements written by the writer form the latent image which is then toned by the development station 306. The development station 306 contains magnetic or non-magnetic toner for example NexPress DryInk or similar and a magnetic carrier such as that detailed in U.S. Pat. No. 4,546,060 A. In the preferred implementation, the magnetic toner will have a viscosity between 1 and 200,000 cp and an elasticity of between 0.1 and 20. The magnetic toner may contain between 10 and 30 parts per hundred (pph) magnetic iron oxide such as that sold by Magnox-Pulaski Inc. The magnetic toner may optionally contain optical, UV, or IR pigments and optional abrasion aids. Magnetic toner such as that detailed in U.S. Pat. No. 6,766,136 B2 is preferred. The toner image element is then transferred to the transfer member 308 and then to a receiver 318. Subsequent imaging units, such as 202, 204, 206, and 208 from FIG. 2, apply additional image elements to the receiver 318 in a similar manner.

Referring now to FIG. 2, the image on receiver 218 with the accumulated magnetic and non-magnetic toner image elements is fixed by heat, pressure, UV or IR radiation, solvent, or other means well known in the art. In a preferred embodiment, the image is fixed via heat and pressure by fixing members 212 and 214. The preferred temperature of image fixation is between 150 and 200 C and pressures from 40 pounds/in$^2$ to 400 pounds/in$^2$. A preferred embodiment uses fixing temperatures between 160 C and 185 C and pressures between 40 pounds/in$^2$ to 400 pounds/in$^2$.

Fixing of the combined toner image elements results in an image element with adequate signal strength and improved adhesion to a wide range of substrates. The magnetic waveform signal strengths for Magnetic Ink Character Recognition (MICR) character printed using the preferred embodiments of the proposed invention are 100-120% for "on-us" characters which are the characters usually printed to the left of the routing field on the MICR line often used for commercial checks for the placement of consecutive serial numbers like on a check or like but could be other similar locations relative to a first location. MICR character signal strength was measured using an RDM MICR qualifier produced by RDM Corporation. The qualifier measured the magnetic signal intensity of the MICR characters printed on the receiver. The industry standard requires magnetic signal strength of MICR characters to be between 50% and 200%.

The magnetic and non-magnetic image elements printed and fixed using the proposed invention shows increased resistance to abrasion when passed through an industry standard reader-sorter. Reading and sorting of checks is the primary application of magnetic toner print images. The industry standard equipment is the IBM 3890 high-speed reader-sorter. Magnetic toner print images are routinely subjected to repeated passes through the equipment as the check is routed from its point of use to its bank of origin. A standard test is used to determine the reader/sorter performance of the magnetic toner images printed by the proposed invention. The test involves the following steps:

1. Print 1000 magnetic toner images with a properly formatted MICR character line and well-defined MICR font.
2. Read/Sort the magnetic toner images by passing through the IBM 3890 Reader/Sorter.
3. Remove images that the reader/sorter rejects for any reason 4. Repeat steps 2 and 3, which together form a "pass", for a total of 20 passes.
5. Calculate the reject rate as the number of image failures divided by the total number of reading/sorting events.

For example, if 1000 check images were passed through the reader/sorter and 1 image was rejected on each pass, the reject rate would be 20 rejects divided by 20000 reading/sorting events or a 0.1% reject rate.

Table 1 shows the marked improvements of magnetic toner image elements printed using the proposed inventive system over competitive systems.

TABLE 1

| Print System | IBM 3890 Reader/Sorter Reject Rate |
|---|---|
| Benchmark A | 1.25% |
| Benchmark B | 0.20% |
| Benchmark C | 0.40% |
| Proposed Invention | 0.04% |

In addition to improved reader/sorter reject rates, the signal loss due to abrasion of the magnetic toner image elements is also improved. Table 2 shows the percentage of magnetic signal lost by magnetic toner image elements passed through the reader/sorter 20 times. Signal loss is due to removal of the printed material by the read and write heads in the reader/sorter. The magnetic signal strength of toner image elements was measured before and after reader/sorter testing and the % decrease in the magnetic signal is reported.

TABLE 2

| Print System | Magnetic Image Element Signal Loss |
|---|---|
| Benchmark A | 4.00% |
| Benchmark B | 0.95% |
| Benchmark C | 7.50% |
| Proposed Invention | 0% |

The combination and order of application of image elements by the imaging units make for an array of security features that can be embedded in the document and/or provide magnetic toner characters with greatly improved adhesion to substrates. Examples of the various schemes are detailed below.

Figure 4:
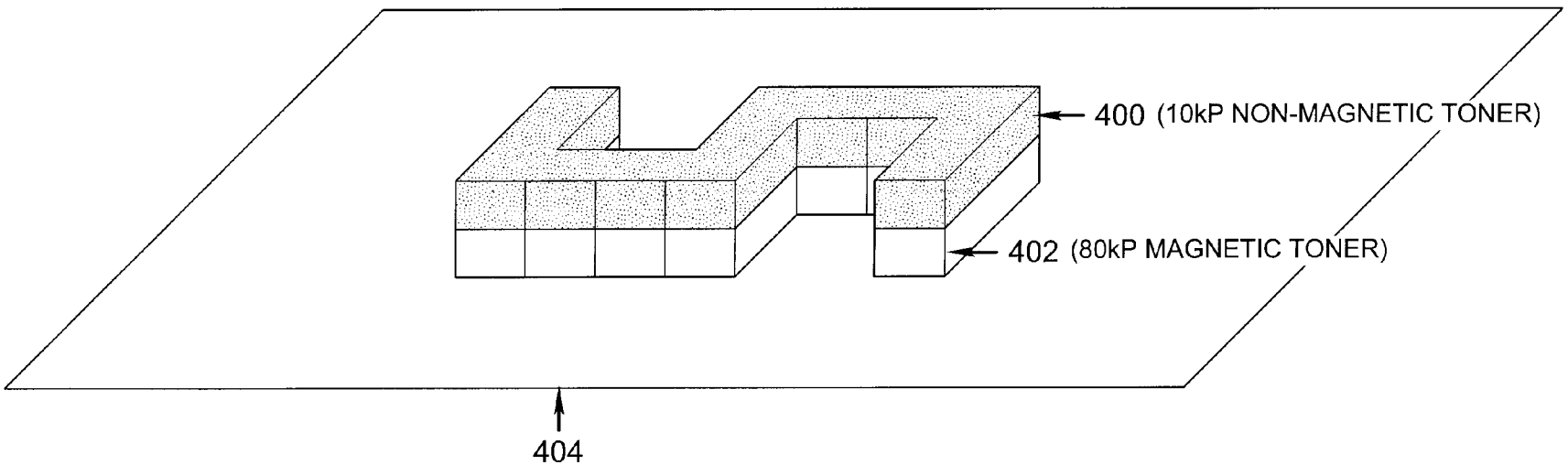
FIG. 4 presents a diagram of a printed character composed of magnetic and non-magnetic toner image elements in accordance with the present invention

Referring now to FIG. 4, one or more magnetic toner image elements 402 are printed on the receiver 404 and subsequently overprinted in whole or in part with non-magnetic toner image elements 400. In this preferred embodiment, the magnetic toner image elements 402 have a viscosity of 80 kP and a tan delta of 0.5. Non-magnetic toner image elements 402 have a viscosity of 10 kP and a tan delta of 2.0. Upon fixing the toner on toner combination with the most preferred method of heat and pressure, the non-magnetic toner image elements change the image quality of the magnetic image element upon fixing. If printed alone, the inherently high viscosity and elasticity of the magnetic toner would preferentially fix to a matte finish. When the magnetic toner image element is overprinted by a lower viscosity, less elastic, non-magnetic toner, the overprinted toner fixes to a highly glossed finish. Document security is realized when attempts to alter the content of the magnetic toner image elements create a change or discontinuity in the apparent gloss of the altered magnetic/non-magnetic toner image element composite.

Figure 5:
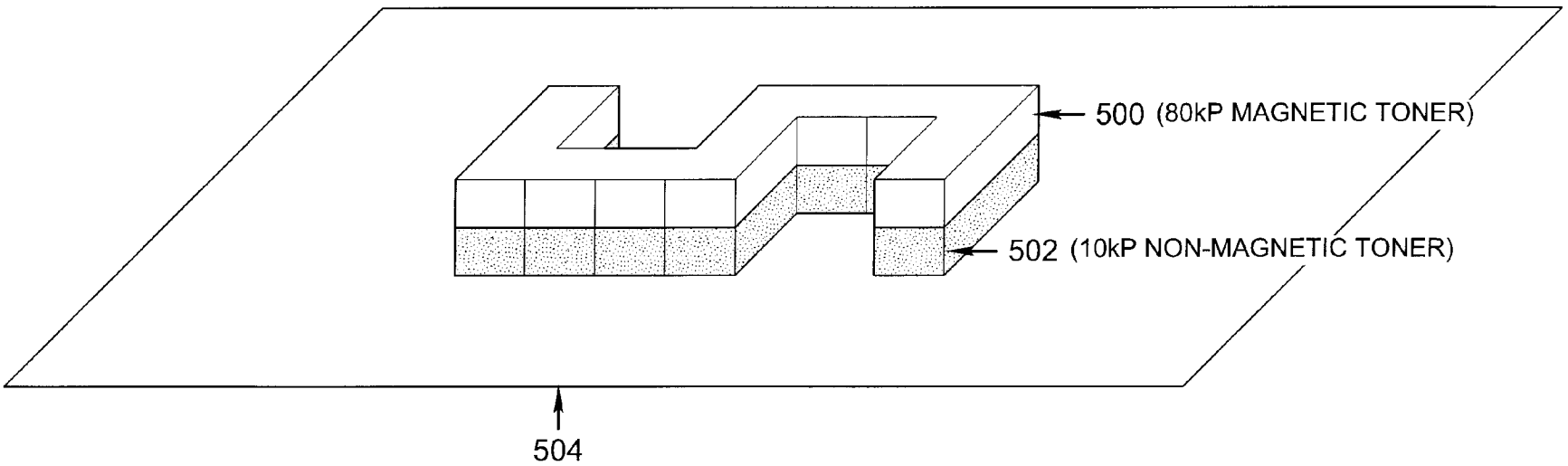
FIG. 5 presents a diagram of a printed character composed of magnetic and non-magnetic toner image elements in accordance with the present invention.

Referring now to FIG. 5, non-magnetic toner image elements 502 are printed on the receiver 504 and subsequently overprinted by magnetic toner image elements 500. The co-printed image is then fixed by heat and pressure whereby the adhesion of the magnetic toner is greatly improved by the presence of the lower viscosity and elasticity of the non-magnetic toner. In a preferred implementation, the non-magnetic toner will have a viscosity of between 1 and 50,000 cp and an elasticity (tan delta) of between 1 and 20 where elasticity is defined as the ratio of the elastic modulus to the storage modulus of the toner. Viscosity and elasticity are measured at 120 C on a parallel plate rheomoter. More preferably, the non-magnetic toner will have a viscosity between 10000 and 15,000 cp and a tan delta between 2 and 4.5. In a preferred embodiment the non-magnetic toner with have a viscosity of between 10 kP and 12 kP and a tsan delta of between 2 and 2.5. The non-magnetic toner may or may not contain optical, UV, or IR pigments. The non-magnetic toner image elements will also be applied to the receiver at an optical transmission density of 0.01 to 5.00. Fixing of the combined magnetic and non-magnetic toner image elements results in an image element with adequate signal strength and improved adhesion to a wide range of substrates.

Figure 6:
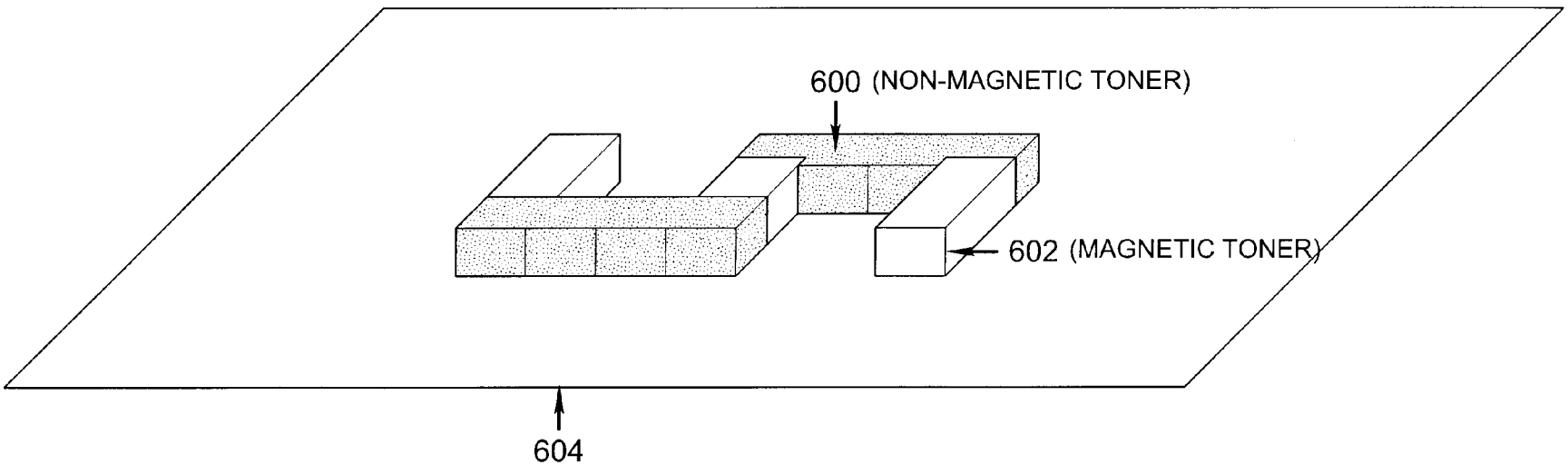
FIG. 6 presents a diagram of a printed character composed of magnetic and non-magnetic toner image elements in accordance with the present invention.

Referring now to FIG. 6, non-magnetic toner image elements 600 are printed adjacent to magnetic toner image elements 602 and the co-printed image is fixed by heat and pressure. Magnetic and non-magnetic image elements are printed beside one another such that neither the magnetic nor the non-magnetic image elements extend over the other. The resulting co-printed and fixed image contains both magnetic and non-magnetic toner but would appear to be composed of non-magnetic toner only. Furthermore, the magnetic and non-magnetic image elements may be arranged in such a way as to encode information that could be decoded at the point of use to determine authenticity.

Figure 7:
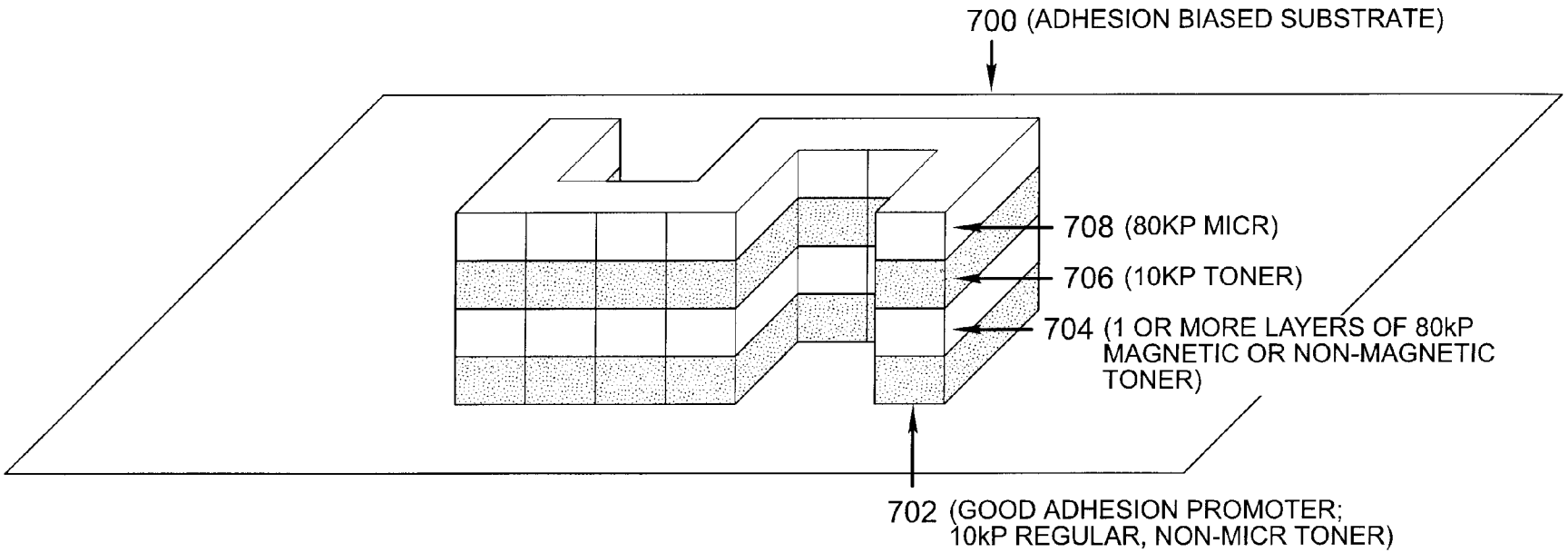
FIG. 7 presents a magnetic ink character recognition (MICR) line image with superior MICR character adhesion in accordance with the present invention.

Referring now to FIG. 7, substrate 700 is a substrate to which adhesion is difficult for the high viscosity 80 kP magnetic toner. Adhesion of the magnetic toner can be improved by first printing non-magnetic toner image elements of 10 kP viscosity and overprinting these with one or more layers of high viscosity magnetic or non-magnetic toners, 704, 706, and 708. This toner stack can furthermore be overprinted with yet another low viscosity toner to impart a high degree of gloss to the otherwise matte image that would result from the high viscosity toner. Using the scheme shown in FIG. 7, many degrees of gloss can be imparted to the image by mixing various amounts and coverages of the low viscosity toner. The result of this toner layering is a well-adhered magnetic toner with a high degree of gloss in the image, yet adequate magnetic signal strength to serve as a MICR image.

Figure 8:
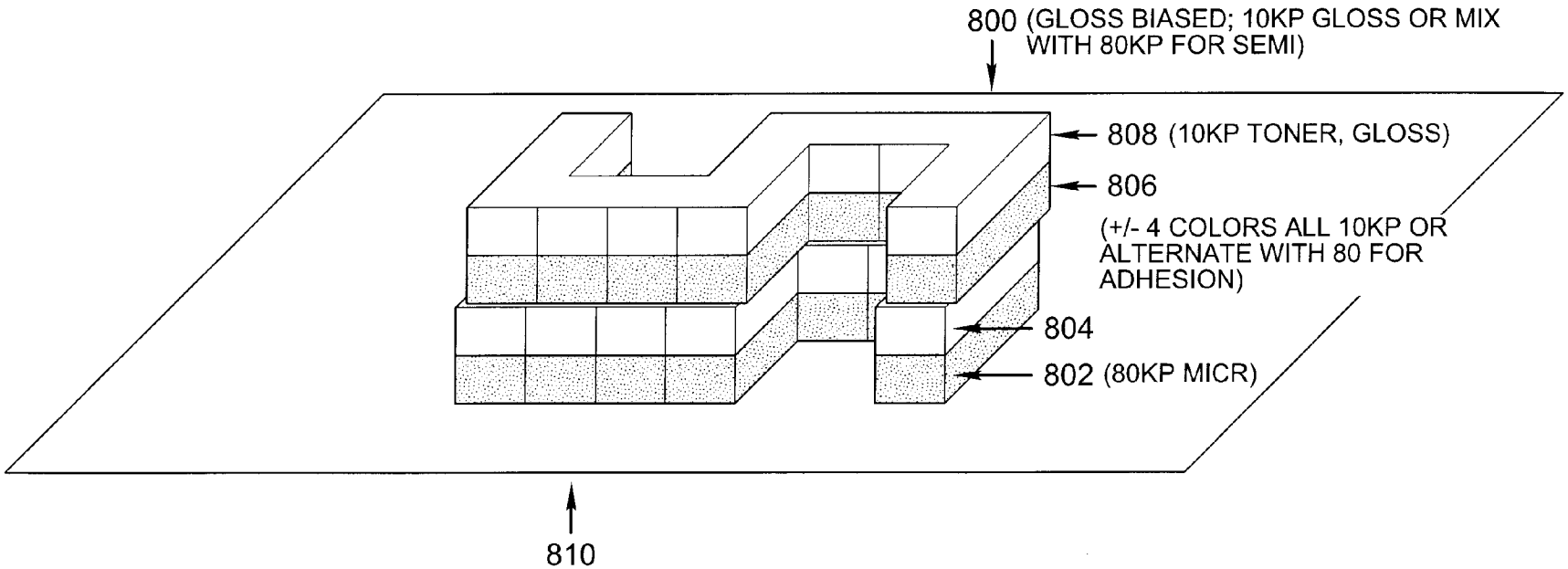
FIG. 8 presents a diagram of a printed character composed of magnetic and non-magnetic toner image elements in accordance with the present invention.

Referring now to FIG. 8, the magnetic high viscosity toner can be first printed on the substrate 800 and further overprinted with one or more layers of high viscosity magnetic or non-magnetic toner. Over the final layer of high viscosity toner can furthermore be printed a layer or partial layer of non-magnetic low viscosity toner to impart a desired degree of gloss to the image. Lower coverages of the low viscosity toner will result in low gloss to the image while higher coverage of the low viscosity toner will result in a higher image gloss. Furthermore, the image elements are fixed at a single temperature and pressure.

Figure 9:
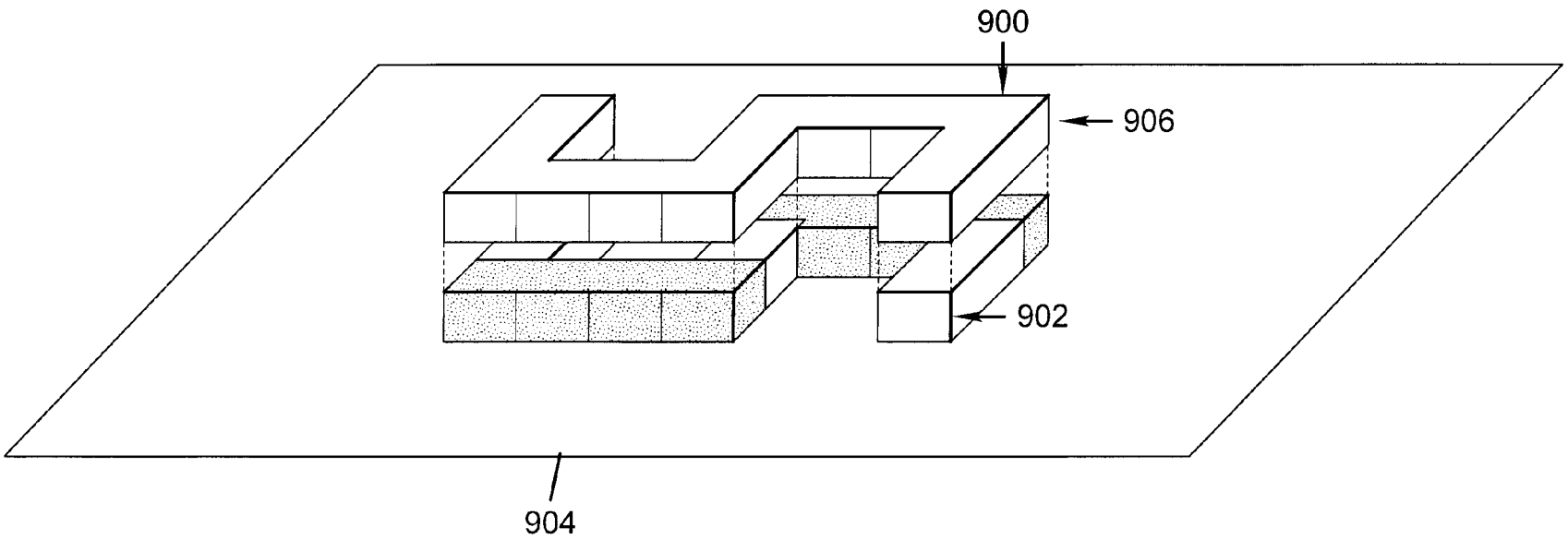
FIG. 9 presents a diagram of a printed character composed of magnetic and non-magnetic toner image elements in accordance with the present invention.

Referring now to FIG. 9, information content may be encoded into the image via magnetic 902 and non-magnetic 906 toner image elements applied adjacent to one another on substrate 904. The arrangement of these toner image elements may produce a pattern that is read via magnetic, optical, IR, UV or other transduction methods known in the art. However, if high viscosity magnetic toner image elements are printed next to low viscosity toner image element, a differential gloss will appear in the image. This is avoided in the embodiment illustrated in FIG. 9. by overprinting the magnetic and non-magnetic image elements with a low or high viscosity toner such that the total image is fixed to a uniform gloss level.

Figure 10:
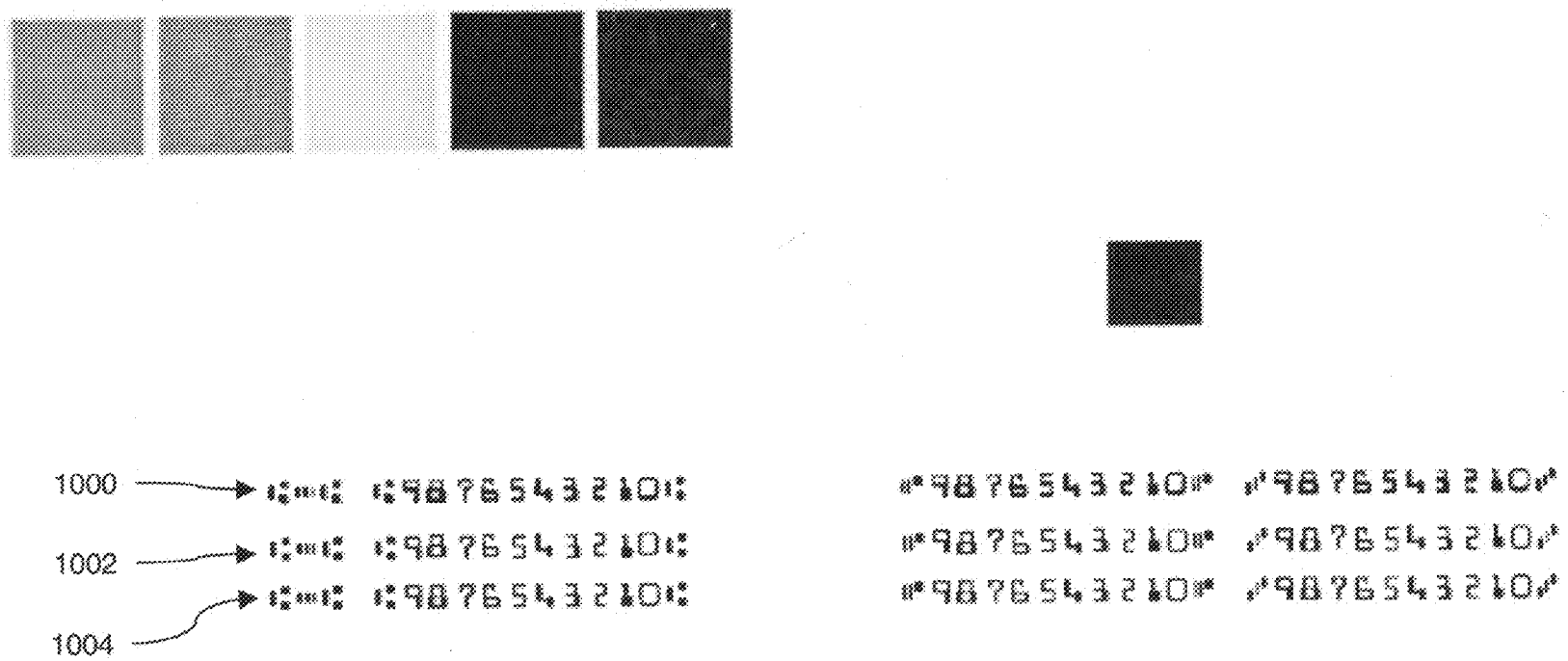
FIG. 10 presents a diagram of a printed character composed of magnetic and non-magnetic toner image elements in accordance with the present invention.

FIG. 10 shows reproductions of actual magnetic and non-magnetic characters printed using the methods described above. 1000 shows a line of non-magnetic toner image elements overprinted by magnetic toner image elements. 1002 shows magnetic and non-magnetic toner image elements printed adjacent to one another. 1004 shows magnetic toner image elements overprinted by non-magnetic toner image elements.

The invention claimed is:

1. A method of generating secure documents comprising:

a. printing a first electrophotographic magnetic toner image element on a receiver with a first finish on an area prior to fusing;

b. co-printing a second non-magnetic toner image element proximate the first image element with a second finish proximate the same area prior to fusing; and c. selecting the first finish for the first toner image element to produce a first final toner image element and the second finish for the second toner image element to produce a second final toner image element such that the first final toner image element and the second final toner image element are indistinguishable to an observer.

2. The method of claim 1, the non-magnetic toner further comprising one or more colored toners.

3. The method of claim 1, the non-magnetic toner further comprising a clear non-magnetic toner.

4. The method of claim 1 further comprising printing the non-magnetic and magnetic toner elements pixel-by-pixel.

5. The method of claim 1, the magnetic and non-magnetic toner image elements being overlaid.

6. The method of claim 5, the toner images further comprising, in a clear coating, additives sensitive to UV or other light.

7. The method of claim 1, the non-magnetic and magnetic toner having different melting points.

8. The method of claim 1, the non-magnetic and magnetic toner having different rheology.

* * * * *